US011237506B2

(12) United States Patent
Maister et al.

(10) Patent No.: US 11,237,506 B2
(45) Date of Patent: Feb. 1, 2022

(54) STATUS OF A TEMPERATURE SENSOR OF A PRINTING DEVICE

(71) Applicant: Hewlett-Packard Development Company, L.P., Spring, TX (US)

(72) Inventors: Dmitry Maister, Ness Ziona (IL); Michel Assenheimer, Ness Ziona (IL); Liran Fanny Haim, Ness Ziona (IL)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/982,728

(22) PCT Filed: May 11, 2018

(86) PCT No.: PCT/US2018/032380
§ 371 (c)(1),
(2) Date: Sep. 21, 2020

(87) PCT Pub. No.: WO2019/216917
PCT Pub. Date: Nov. 14, 2019

(65) Prior Publication Data

US 2021/0055676 A1 Feb. 25, 2021

(51) Int. Cl.

| | |
|---|---|
| ***G03G 15/20*** | (2006.01) |
| ***G03G 15/16*** | (2006.01) |
| ***G03G 15/00*** | (2006.01) |

(52) U.S. Cl.
CPC ..... *G03G 15/205* (2013.01); *G03G 15/161* (2013.01); *G03G 15/169* (2013.01); *G03G 15/2039* (2013.01); *G03G 15/5004* (2013.01); *G03G 2215/00084* (2013.01); *G03G 2215/00666* (2013.01); *G03G 2215/00772* (2013.01)

(58) Field of Classification Search
CPC ..... G03G 15/161; G03G 15/169; G03G 15/2039; G03G 15/205; G03G 15/5004; G03G 2215/00084; G03G 2215/00772; G03G 2215/00666
See application file for complete search history.

(56) References Cited

U.S. PATENT DOCUMENTS

| | | | |
|---|---|---|---|
| 4,538,902 | A | 9/1985 | Inuzuka et al. |
| 6,697,580 | B2 | 2/2004 | Nakayama |
| 8,024,622 | B2 | 9/2011 | Narushima et al. |
| 9,031,427 | B2 | 5/2015 | Odaka |
| 9,791,904 | B2 | 10/2017 | Rosenzweig et al. |

(Continued)

FOREIGN PATENT DOCUMENTS

| | | |
|---|---|---|
| JP | 2015022184 | 2/2015 |
| WO | WO-2017019065 | 2/2017 |

*Primary Examiner* — Joseph S Wong
(74) *Attorney, Agent, or Firm* — Dierker & Kavanaugh PC

(57) ABSTRACT

A printing device containing a heating apparatus that heats an image substrate, a temperature sensor associated with the image substrate and a processor communicatively coupled to the heating apparatus. The processor determines the heating power of the heating apparatus, compares the heating power to a predetermined power range, determines a status of the temperature sensor when the heating power is outside the predetermined power range, and triggers a response mode of the printing device based on the determined status of the temperature sensor.

15 Claims, 6 Drawing Sheets

(56) References Cited

U.S. PATENT DOCUMENTS

| | | | | |
|---|---|---|---|---|
| 2006/0290734 | A1 | 12/2006 | Habuka | |
| 2007/0122173 | A1 | 5/2007 | Mitsuoka et al. | |
| 2014/0199086 | A1* | 7/2014 | Odaka ..... | G03G 15/2053 399/33 |

* cited by examiner

STATUS OF A TEMPERATURE SENSOR OF A PRINTING DEVICE

BACKGROUND

Printers, such as liquid electrophotographic printers (LEP), form images on print media. To do so, a liquid electrophotographic printer may place a uniform electrostatic charge on an imaging element, such as a photo imaging plate (PIP), and then selectively discharge the imaging element to form a latent electrostatic image. A printing fluid is then applied to the latent image on the photo imaging plate and attracted to the partially discharged surface, thereby creating an inked image on the photo imaging plate.

The inked image may then be transferred on to a transfer member, such as an image transfer blanket on an intermediate transfer member (ITM). From the transfer member, the inked image is transferred onto print media.

BRIEF DESCRIPTION OF THE DRAWINGS

Various features of the present disclosure will be apparent from the detailed description which follows, taken in conjunction with the accompanying drawings, which together illustrate, features of the present disclosure, and wherein.

DETAILED DESCRIPTION

Figure 1:
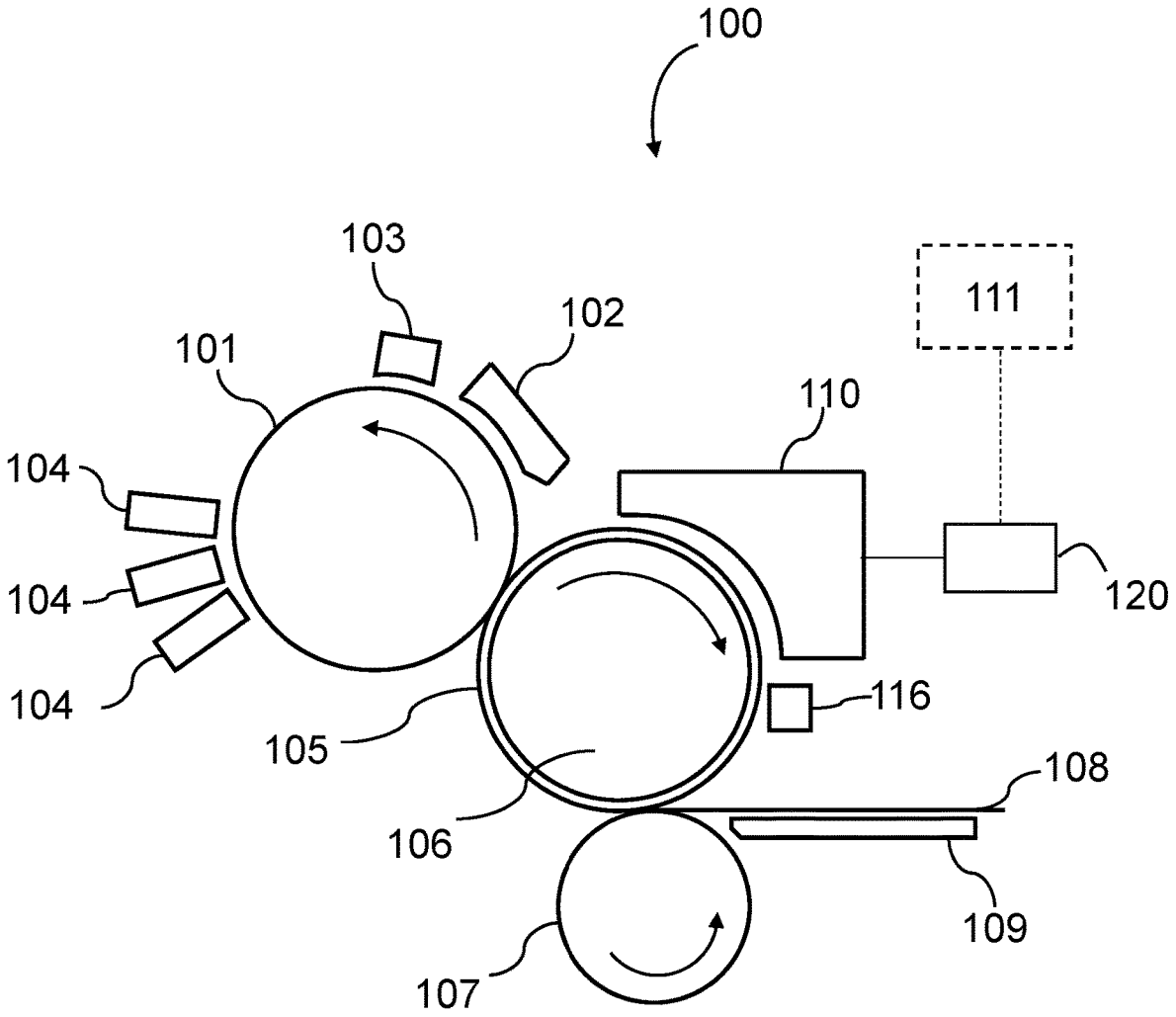
FIG. 1 is a schematic diagram of a printing device, according to an example.

In an example printing device, an inked image on a transfer member, such as an image transfer blanket on an intermediate transfer member drum, may be heated by a heater so that the colourants of the printing fluid fuse together and one or more components of the printing fluid, such as a solvent of the printing fluid, are evaporated. The resulting image layer on the transfer member is then transferred to print media, for example a sheet of paper. In a variation to the herein described examples, the intermediate transfer member may be an intermediate transfer belt, or other means with a surface able to be rotated to receive an inked image form a photo imaging plate and subsequently, transfer the inked image to print media.

The heater may be in the form of an internal heater of the transfer member, an external heater of the transfer member, or both. In one example, an internal heater heats the intermediate transfer member drum, which causes heating of the underside of the image transfer blanket. That is, an internal heater indirectly heats the image transfer blanket. In one example, an external heater heats the outer surface of the image transfer blanket that is in contact with the inked image. That is, an external heater directly heats the image transfer blanket. Accordingly, each of an internal heater and an external heater cause heating of the image transfer blanket. In one example, the surface of the image transfer blanket is heated to a temperature that allows the evaporation and fusion of components of the printing fluid, as described above.

The image transfer blanket and intermediate transfer drum may each be considered as an image substrate because the inked image is directly formed on the image transfer blanket and indirectly formed on the intermediate transfer drum. In another example, the image transfer blanket and the intermediate transfer drum may together be considered an image substrate.

The heating of an image substrate on which an inked image is formed, such as the transfer member, by a heater may be controlled in a feedback loop including a temperature sensor that measures the temperature of the image substrate. The heat transmitted by the heater is driven by a temperature measured by the temperature sensor and a set-point temperature.

During printing, the heating power input to a heating apparatus may vary widely due to rapidly changing input conditions, for example, different types of print media, varying ink coverage in an inked image, and different printing modes. Therefore, a feedback loop based on temperature may be used over a feedback loop based on heating power.

However, during use of the printing device, dirt may accumulate on the temperature sensor, the field of view of the temperature sensor may become partially blocked, and the temperature sensor may experience signal drift.

In one example, the window of the temperature sensor may be contaminated. In this case, part of the infrared energy incident on the window is absorbed in the contamination layer and the temperature sensor measures a lower signal, which is interpreted as a lower temperature. In another example, if the field of view is partially obstructed or blocked, less energy arrives for a given target temperature at the sensing surface of the temperature sensor. The temperature sensor will generate a temperature signal that is lower than that of the surface to be measured. In some sense the sensor assumes there is no obstruction of the field of view.

Accordingly, the temperature sensor may malfunction causing readings by the temperature sensor to become inaccurate.

Inaccurate temperature readings may cause the actual temperature of the image substrate to be higher than the measured temperature, resulting in components of the printer, such as the image substrate, to be continuously and significantly overheated above the desired set point temperature. Overheating of printer components reduces their long-term performance. This causes degradation in printing quality and will dramatically shorten the lifespan of the printer components.

Similarly, inaccurate temperature readings may cause the actual temperature of the image substrate to be lower than the measured temperature, resulting in insufficient heating of the image substrate. Insufficient heating of the image substrate may result in a reduction in print quality due to the printing fluid not being properly fixed in place on the print media.

Accordingly, to avoid these issues, an example printing device as described herein provides a way of determining a status of a temperature sensor.

An example printing device comprises a heating apparatus arranged to heat an image substrate, a temperature sensor associated with the image substrate, and a processor communicatively coupled to the heating apparatus. The processor is configured to determine the heating power of the heating apparatus, compare the heating power to a predetermined power range, determine a status of the temperature sensor when the heating power is outside the predetermined power range; and trigger a response mode of the printing device based on the determined status of the temperature sensor.

The heating power of the heating apparatus may be the power of an input (or a proxy thereof) to the heating apparatus. In another example, the heating power may be power output (or a proxy thereof) by the heating apparatus.

In another example, a second status of the temperature sensor is determined when the heating power is inside the predetermined power range. In this case, the second status may cause the printing device to remain in a current mode or may trigger a different mode in the printing device.

The example printing device can detect malfunctions in a temperature sensor without having to rely on a diagnosis based on poor print quality and/or on degradation of the lifespan of a component of the printing device, where such a diagnosis occurs too late for any preventative action to be taken.

In this way, the example printing device provides early detection of temperature sensor malfunction and drives any preventative action before printing quality or component lifespan is significantly impacted. In current systems, service or support engineers perform a troubleshooting operation using an additional external temperature sensor to eliminate the possibility of the sensing issue being associated with the temperature control system and/or to validate the accuracy of the temperature sensor of the printing device. Additionally, a service or support engineer, and/or operator, also relies on previously identified print quality outputs for a specific application of the printing device to validate the accuracy of the temperature sensor of the printing device. The use of an additional temperature sensor is complicated because the architecture of a printing device does not allow for a comparison to be made between readings from both sensors in the same location whilst the device is printing. Due to the preventative and proactive nature of the example printing device the example printing device can reduce service calls and save time and cost of the support engineers.

In more detail, the printing device is preventative (by identifying possible malfunction and triggering a response mode in the device) and is proactive (by identifying malfunction before a significant reduction in print quality or a significant reduction in lifespan of a component occurs). Time of a field engineer is saved because a proactive indication of temperature sensor is determined so less time is spent troubleshooting. Cost of support engineers is reduced because skill level is reduced (less troubleshooting). Number of service calls is reduced because preventative action can be taken.

An example printing device 100 is depicted in FIG. 1. According to the example of FIG. 1, in use, a photo imaging plate (PIP) 101 is rotated under a charging system 102. In this example, the photo imaging plate 101 is cylindrical and constructed in the form of a drum. The charging system 102 places a uniform electrostatic charge on the photo imaging plate 101 (also referred to as a "photoreceptor"). The charging system 102 may include a charging device, such as corona wire, a charge roller, or any other charging device.

As the photo imaging plate 101 continues to rotate, it passes a writing head 103 where one or more laser beams dissipate localized charge in selected portions of the photo imaging plate 101 to leave an invisible electrostatic charge pattern that corresponds to the image to be printed, i.e. a latent image.

Next, printing fluid, such as ink, is transferred onto the photo imaging plate 101 by at least one image development unit 104 (also referred to as a binary ink developer unit). There may be an image development unit 104 for each ink colour. During printing, the appropriate image development unit 104 is engaged with the photo imaging plate 101. The engaged image development unit 104 presents a uniform film of ink to the photo imaging plate 101. The electrically charged ink particles are attracted to the opposing charges on the image areas of the photo imaging plate 101 ("zero transfer").

The ink may be a liquid toner, comprising ink particles and a carrier liquid. The carrier liquid may be a dielectric fluid such as an oil. An example liquid toner ink is HP ElectroInk. In this case, pigment particles are incorporated into a resin that is suspended in a carrier liquid, such as isoparrafin solvents.

Returning to the printing process, the photo imaging plate 101 continues to rotate and the inked image is transferred to an image substrate, such as intermediate transfer member drum (ITM) 106 ("first transfer"). In this example, an image transfer blanket 105 resides on the outer surface of the ITM 106. The ITM 106 rotates in a direction opposite to that of the photo imaging plate 101.

Once transferred to the ITM 106, the printing fluid of the inked image is heated by a heating apparatus 110 as the ITM 106 rotates. In the example of FIG. 1, the depicted heating apparatus, heating apparatus 110, is an external heater that heats the surface of the transfer blanket 105. The heating apparatus may be at least one heat lamp, such as at least one Infra-Red heating lamp. In other examples, the heating apparatus 110 may be an internal heater of the ITM 106 and image transfer blanket 105. For example, an internal heat lamp. In a further example, the heating apparatus may be at least one external heater and at least one internal heater. For example, the heating apparatus may be at least one internal heat lamp and at least one external heat lamp. In another example, the printing device 100 may comprise a second heating apparatus that works in combination with the heating apparatus 110. For example, the second heating apparatus may cause heating by provided hot air streams. In a scenario where the heating apparatus comprises more than one heater (internal or external) each heater may be independently associated with corresponding temperature sensors and, consequently, be controlled independently. Alternatively, each heater may be associated with the same temperature sensor and, consequently, controlled together.

The heating apparatus 110 heats the inked image on the image transfer blanket 105 so that the colourants of the printing fluid fuse together and one or more components of the printing fluid, such as a solvent of the printing fluid, are evaporated. In one example, the printing fluid is a carrier.

A temperature sensor 116 is associated with the image transfer blanket 105 and measures the surface temperature of the image transfer blanket 105. In the example of FIG. 1, the temperature sensor 116 is positioned so that the sensor 116 can measure the temperature of the image transfer blanket 105. In this example, the sensor 116 is a non-contact temperature sensor positioned adjacent the image transfer blanket 105. In another example, the temperature sensor 116 may be in direct contact with the image transfer blanket.

The temperature sensor 116 is part of a feedback loop (discussed below, with reference to FIG. 3) that controls the heating power of the heating apparatus 110. In this example, the temperature sensor 116 is an Infra-Red temperature sensor, such as an Infra-Red thermometer, that converts incident Infra-Red radiation into an electrical signal. Other examples of temperature sensors that may be used are: a thermistor-based sensor, a resistor-based sensor, a thermocouple, a thermochromic sensor, a semiconductor-based sensor, and a sensor that senses a temperature-dependent physical property.

Figure 2:
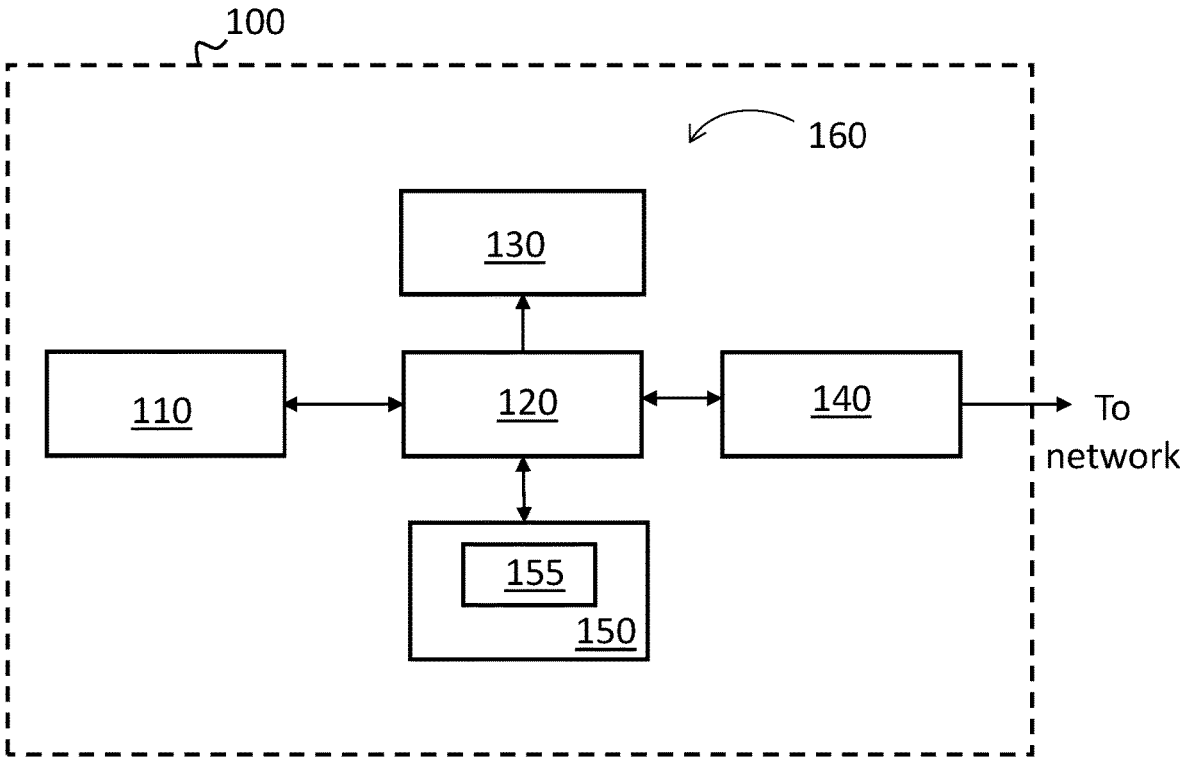
FIG. 2 is a block diagram of device circuitry of the printing device of FIG. 1, according to an example.
Figure 3:
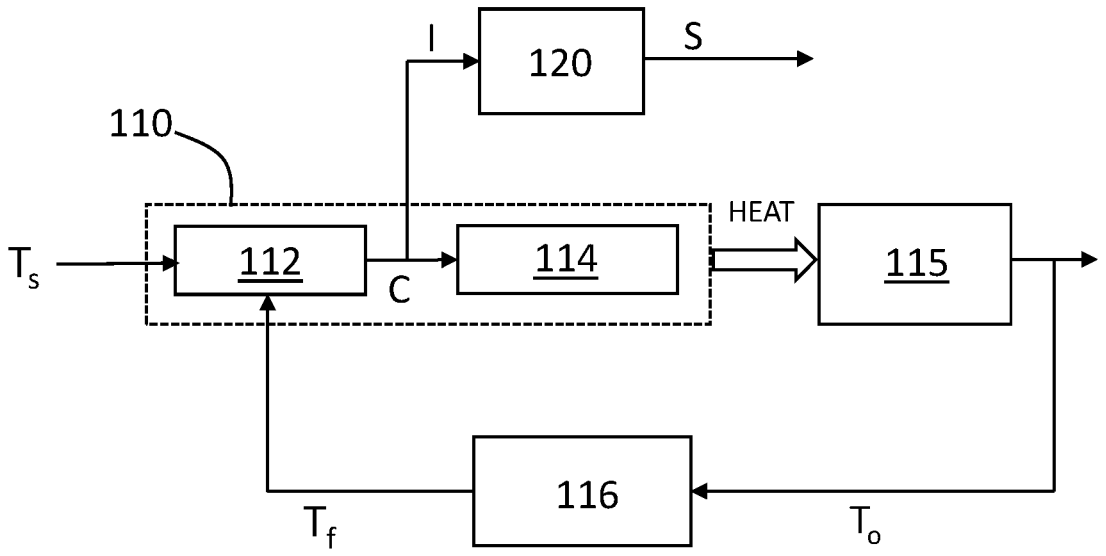
FIG. 3 is a block diagram of a feedback loop of the printing device of FIGS. 1 and 2, according to an example.

A processor 120 is communicatively coupled to the heating apparatus 110 (described in more detail in relation to FIGS. 2 and 3). The processor 120 executes instructions 111 that cause the later-described methods 200 and 290 to be implemented.

After heating, the resultant image layer is guided between a surface of a rotating impression roll 107 and the surface of the image transfer blanket 105 so that the image layer is transferred onto a print media 108 ("second transfer"). In this example, the print media 108 is supported by a media substrate 109 as the print media 108 is guided between the impression roll 107 and the image blanket 105. In one example, the print media 108 maybe a cut-sheet of paper, whereby, the printing device 100 performs sheet-fed printing. In such an example, the print media may be held in place on the surface of the impression roll 107 by a fastening means (not shown). Alternatively, the print media 108 may be in the form of a continuous roll, whereby the printing 100 device performs web printing. The print media 108 may partially wrap around the impression roll 107.

Referring to FIG. 2, example device circuitry 160 of the printing device 100 is shown. The device circuitry 160 includes the heating apparatus 110 and the processor 120 (discussed above, in relation to FIG. 1), and a user interface device 130, a communication device 140, and a memory 150.

The processor 120 is communicatively coupled to the heating apparatus 110. In use, the processor 120 determines the heating power of the heating apparatus 110. The heating power may be derived from a proxy measurement, such as a voltage, current, or frequency measurement. The processor 120 may determine the heating power continuously through operation of the printing device. In one example, the processor 120 may determine the heating power at a predetermined rate.

Following the determination of the heating power, the processor 120 compares the heating power to a predetermined power range. In one example, the predetermined power range represents a power range in which the temperature sensor 116 is working normally (that is, not malfunctioning). In one example, the predetermined power range may be based on the different power ranges associated with different input conditions, such as print media, printing fluid coverage, and printing modes of the printing device 100. Deviation from the predetermined power range is indicative of an abnormality in the temperature sensor 116. In one example, the predetermined power range is set by upper and lower thresholds that are selected to be insensitive to power ranges used when covering one or more of the following: various printing modes, different print media types, different ink coverages, and different ink applications. In this way, heating power can be associated with normality or abnormality (malfunction) in the operation of the temperature sensor 116. Comparison of the heating power to such a predetermined power range provides an early indication of whether the temperature sensor 116 is operating normally. In one example, the predetermined power range may be specific to the printing device. That is, the predetermined power range may be personalized for the specific printing device. Although printing devices may be similar, the normal/abnormal power range for each of them may be different (this may be due to learning of the device over time as the printing device operates or printing application specific impacts, etc.).

The predetermined power range may be calculated by the processor 120 using a theoretical heat model.

Additionally, or alternatively, the predetermined power range may be calculated from a history of power ranges of the printing device 100.

Additionally, or alternatively, the predetermined power range may be calculated from a power range of one other printing device.

Additionally, or alternatively, the predetermined power range may be calculated from one or more power ranges of a plurality of other printing devices.

Additionally, or alternatively, the predetermined power range may be calculated based on analysis of operating data of at least one other printing device that has at least one feature in common with the printing device. For example, the plurality of other printing devices may have at least one of the following features in common with the printing device: manufacture date, batch number, printing device type. In one example, the predetermined power range may be calculated based on operation of a printing device during manufacture or testing, where such operation is representative of a golden benchmark for a predetermined power range for other printing devices.

In on example, the predetermined power range may be calculated based on printing device component performance. For instance, component performance of at least one component of a plurality of printing devices may be stored in a central database. In one example, performance of a photoreceptor component of the printing device across its lifespan may be correlated with heating power used in a plurality of printing devices, and the predetermined power range is based on the heating power ranges that correlate with desired lifespan of the photoreceptor component. In other examples, lifespans of different components in relation to heating power may form the basis of the predetermined power range. The determination of the predetermined power range is described in more detail in relation to FIG. 5.

In one example, a predetermined power range may be one of the following: less than 2000 W, less than 1500 W, less than 1200 W, and less than 1000 W. In another example, a predetermined power range may be one of the following: between 500 W and 2000 W; between 1000 W and 1800 W; and between 1200 W and 1700 W; and between 1100 W and 1600 W. In one example, "between" may be interpreted as greater than or equal to and less than or equal to.

Alternatively, the predetermined power range may be calculated for a total of heating power for at least one heating apparatus of the printing device.

Accordingly, the printing device 100 may be connected via a network to at least one of: a database associated with the printing device 100, a database associated with one other printing device, and a database associated with a plurality of other printing devices. In each of these examples, the database stores data, for the related printing device(s), on at least one of the following: at least one historical heating power; at least one historical temperature set point; at least one preset heating power; and at least one preset temperature set point.

In one arrangement the printing device 100 is connected to such a network through a communication device, such as communication device 140 of the device circuitry 160.

In one example, the predetermined power range may be derived from power ranges of other printing devices, where the other printing devices and the printing device 100 are connected over a network to a central database. The central database may store heating power and temperature set points and other data that is continuously collected over time from each of the printing devices. In such an example, the predetermined power range may be an average power range of the power ranges of the other printing devices, either calculated by the processor 120 or provided by a database associated with the other printing devices. In another example, the predetermined power range may be a statistic metric of the power ranges of the other printing devices. In another example, the predetermined power range may be calculated from a history of power ranges of the printing device 100, where the history of power ranges is retrieved from a database associated with the printing device 100.

When the heating power is outside the predetermined power range, the processor 120 determines a status of a temperature sensor associated with the heating apparatus 110 such as the temperature sensor 116 of FIG. 1. In one example, the status indicates that the temperature sensor 116 is malfunctioning. As explained earlier, whether the temperature sensor is determined to be malfunctioning is based on the relation between the heating power and the predetermined power range. The predetermined power range may be adjustable so that a smaller range results in more determinations of malfunctioning and a larger range results in less determinations of malfunctioning.

Subsequently, the processor 120 triggers a response mode of the printing device 100 based on the determined status of the temperature sensor 116, which, as described above, is derived from the heating power.

In the response mode of the printing device 100, the processor 120 is configured to trigger at least one of: a status feedback to a user of the printing device 100; and a status feedback to a remote party associated with the printing device 100. The processor 120 may trigger other responses within the printing device that serve to notify a party of the status of the temperature sensor. In one example, in a response mode, a printing device may act to prevent further printing in suboptimal conditions. Such action may cause immediate prevention of further printing or may cause the prevention to occur at some point in the future.

As described above, a status feedback may be provided to a user of the printing device 100. Such a status feedback may be provided through a user interface, such as user interface 130 communicatively coupled to the processor 120. In this case, the user interface 130 may have a display and the status feedback is provided as visual feedback on the display. In addition to, or instead of, visual feedback, audio or haptic feedback may be provided to a user through the user interface 130. In a further example, the printing device may change state, such as changing to a lower state. For example, changing from a printing state to a standby state.

As an alternative, the status feedback to a user may be provided over a network to a device of the user. Similarly, a status feedback to a remote party may also be provided over a network to a device of a remote party.

In one example, the status feedback may be repeatedly provided to a recipient until the recipient acknowledges the status feedback.

To provide a status feedback over a network, the processor 120 communicates with the communication device 140 of the device circuitry 160. The communication device 140 may communicate with a device of the user, such as a mobile phone of the user, and/or a device of a remote party, such as a mobile phone of a service engineer and/or a database accessible by the service engineer, over a network. In the latter case, a service engineer may access the database to pull data associated with the printing device 100 from the database.

When the determined heating power is within the predetermined power range the processor 120 repeatedly determines the heating power of the heating apparatus 110 and compares the heating power to the predetermined power range. In one example, the processor 120 may communicate with the communication device 140 so that the communication device 140 sends a message indicating that the temperature sensor 116 is functioning normally. In one example, the communication device 140 may send such a message to a device of the user, such as a mobile phone of the user, and/or a device of a remote party, such as a mobile phone of a service engineer, over a network. In one example, the message indicating that the temperature sensor is functioning normally may be repeatedly sent, corresponding to the repeated determination of the heating power by the processor 120

The processor 120 is also coupled to a memory 150 of the device circuitry 160. The memory 150 contains computer readable storage medium 155 encoded with instructions for the processor 120. In addition, the memory 150 may store historical power ranges of the printing device 100 that may be used by the processor 120 to calculate the predetermined power range. For instance, the processor may calculate an average of historical power ranges as the predetermined power range. Alternatively, the most frequently used historical power range may be used as the predetermined power range. In a further example, the historical power range data may be used by the processor 120 to determine if there is trend in behavior of the printing device or a component thereof. The trend may be indicative of a temperature sensor deterioration or performance degradation. For example, a trend may indicate an increase in dirt accumulation on the temperature sensor.

In another example, a trend in behavior of the printing device or a component thereof may be based on least one of: a history of heating power of the heating apparatus, a history of power ranges of the printing device; a power range of one other printing device; and one or more power ranges of a plurality of other printing devices.

FIG. 3 depicts a feedback loop of the printing device 100 of FIGS. 1 and 2. The heating apparatus 110 has a heating controller 112 and a heating element 114. The heating controller 112 supplies a control signal C to the heating element 114.

In response to receipt of the control signal C, the heating element 114 applies heat to an image substrate 115, such as the image transfer blanket 105 and the intermediate transfer member drum 106. The temperature sensor 116 associated with the image substrate 115 converts a sensor input signal (for example, incident Infra-Red energy), corresponding to an output temperature $T_o$, to a temperature feedback signal $T_f$ that is transmitted to the heating controller 112.

The heating controller 112 modifies the control signal C based on the temperature feedback signal $T_f$ and a temperature set point signal $T_s$. For example, the control signal C may be modified to cause an increase or a decrease of the heating power of the heating apparatus 110. In one example, the control signal C may be modified to cause an increase or decrease of heating power based on a difference between the respective temperatures corresponding to the temperature feedback signal $T_f$ and the temperature set point signal $T_s$.

The control signal C is probed by the processor 120, which receives an input signal I. In one example, a sensor (not shown) may probe signal C and supply the input signal I to the processor 120, where input signal I may be representative of the control signal C or a characteristic (such as amplitude, frequency, voltage, current, power) thereof.

The processor 120 determines the heating power of the heating element 114. The processor 120 may determine the heating power from a proxy, such as current, voltage or frequency of the control signal C. After the heating power is determined, the processor 120 outputs a trigger signal S, as appropriate.

In another example of a feedback loop, a processor may determine the temperature feedback signal $T_f$ from the output temperature $T_o$ measured by the temperature sensor 116. In such a scenario, the processor may be an additional processor to processor 120 or may be processor 120. Alternatively, the determination of the temperature feedback signal $T_f$ from the output temperature $T_o$ may be implemented in hardware, for instance, in electronics.

In a variation, a further temperature sensor and a corresponding further feedback loop may be included in the printing device 100.

Figure 4:
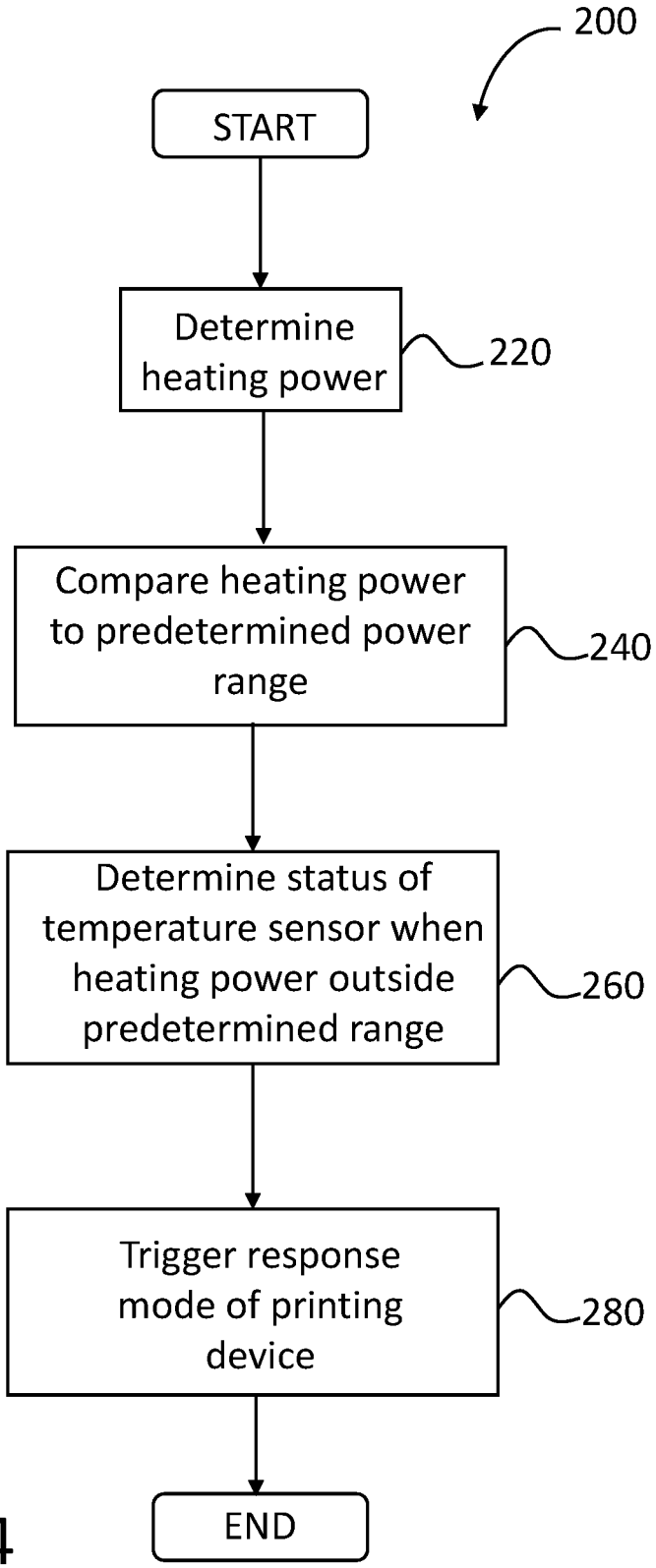
FIG. 4 is a flowchart of a method carried out by the printing device of FIGS. 1 and 2, according to an example.

Referring to FIG. 4, a computer-implemented method 200 carried out by the printing device 100 is depicted. The method 200 starts at block 220 where a heating power of a heating apparatus 110 of the printing device 100 is determined. In one example, the method 200 may begin with determining that the temperature, resulting from heating by the heating apparatus, is stable.

Next, at block 240, the heating power is compared to a predetermined power range.

Following the comparison, at block 260, when the heating power is outside the predetermined power range, a status of a temperature sensor 116 associated with an image substrate 115 heated by the heating apparatus 110 is determined. The status may be indicative of whether the sensor 116 is malfunctioning.

After the status is determined, the method 200 proceeds to block 280, where a response mode of the printing device 100 is triggered based on the determined status.

In one example, if the determined status of the sensor 116 indicates that the sensor 116 is not working properly, that is the sensor is malfunctioning, the response mode of the printing device 100 is triggered. In one example, the response mode is triggered automatically. Alternatively, the response mode may be triggered based on an external input, for example, by a service engineer or an operator, or both.

Figure 5:
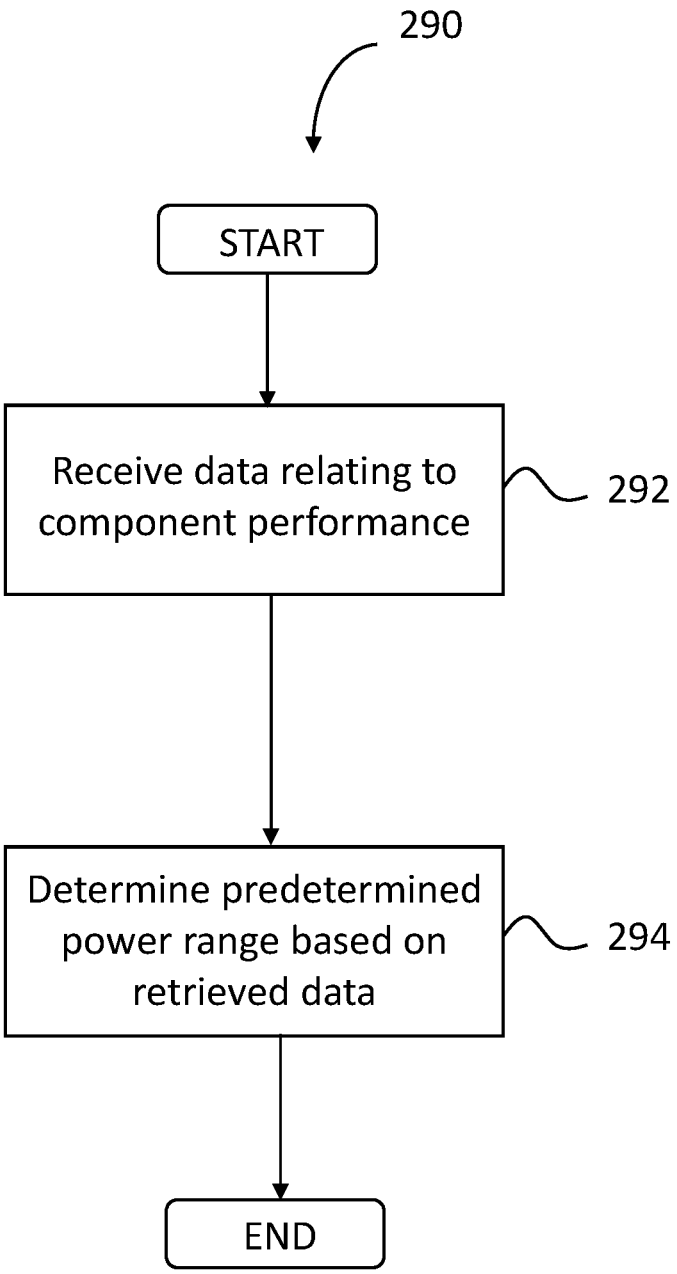
FIG. 5 is a flowchart of a method carried out by the printing device of FIGS. 1 and 2, according to an example.

FIG. 5 is a flow chart of a computer-implemented method 290 carried out by the printing device 100. In one example, the method 290 may be carried out prior to the method 200 of FIG. 4. More specifically, the method 290 may be carried out prior to the block 240 of the method 200.

The method 290 starts at block 292 where data relating to component performance of at least one component of the printing device 100 is received. In one example, the data may be received by the printing device 100 from a central database via a network. In one example, the data relating to component performance may be historical performance data of the component. The historical performance data may be representative of the lifespan of the component in relation to heating power of a heating apparatus of the printing device. In this way, the data relating to component performance is specific to the printing device 100.

Following block 292, the method 290 proceeds to block 294 where a predetermined power range for the printing device 100 is determined based on the received data. In one example, the predetermined power range may be determined based on a desired lifespan of the component, where the predetermined power range corresponds to a power range that allows the desired lifespan of the component to be reached.

In one example, the component referred to in relation to FIG. 5 may be the photo imaging plate 101 of the printing device 100.

In one example, lifespans of a plurality of components corresponding to a plurality of printing devices are determined or retrieved. In addition, heating powers of the plurality of printing devices are determined. Next, the lifespans are correlated against the determined heating powers. A predetermined power range is determined based on the correlation between the lifespans and the heating powers. The predetermined power range may be stored in each of the printing devices or stored in a central database connected to each of the printing devices via a network.

The two-phase process of:

(1) determining the predetermined power range based on component data (for example, component lifespan) for a plurality of printing devices within an installed base, and possibly all the printing devices of an installed base (described in relation to FIG. 5); and (2) using the predetermined power range in determining whether a printing device is malfunctioning (as described in relation to FIG. 4)

provides a tailored approach to detecting a malfunction in the temperature sensor.

In one instance, lifespans of a plurality of components may be determined for all printing devices within an installed base.

Figure 6:
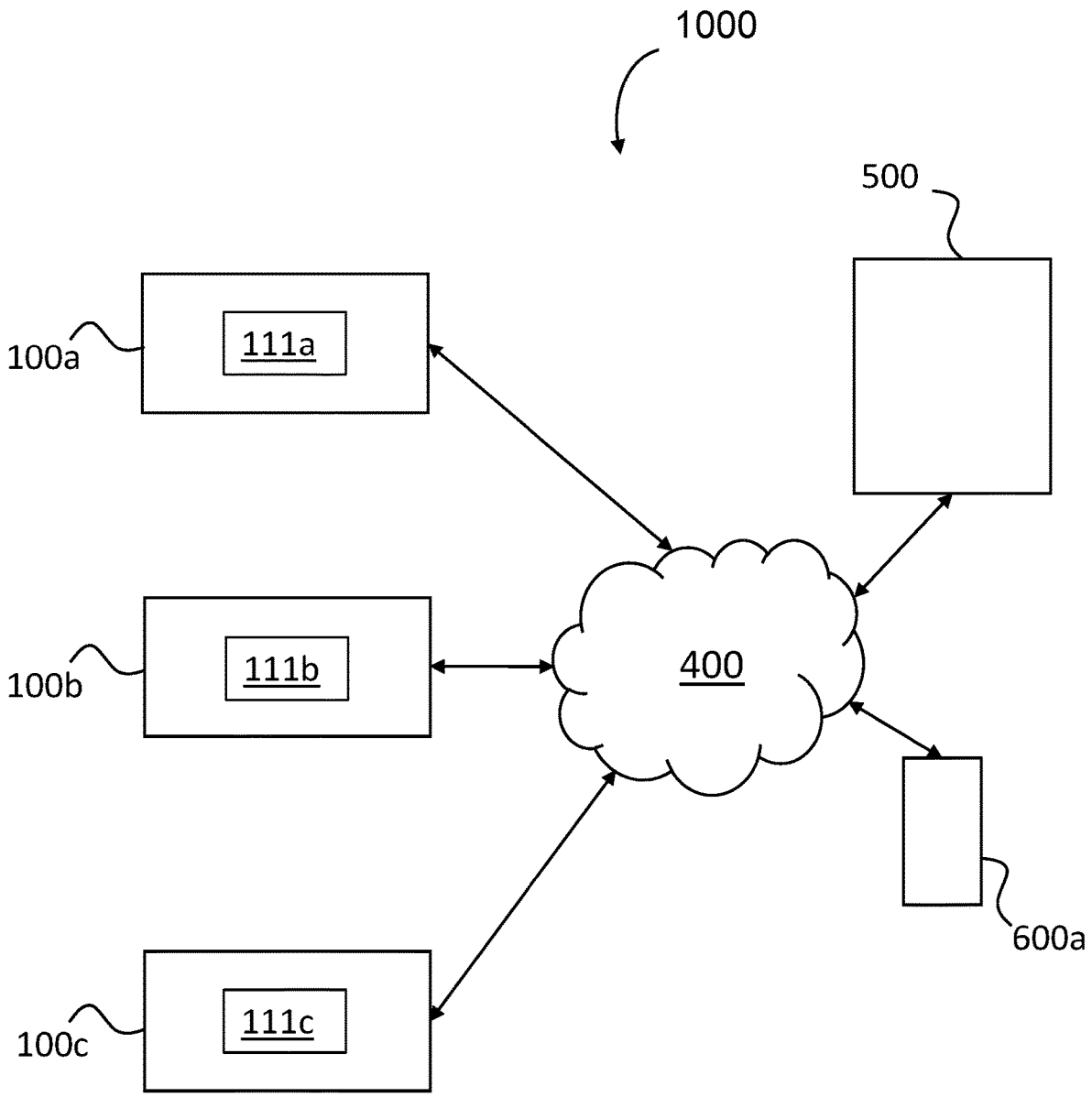
FIG. 6 is an illustration of a printer network, according to an example.

FIG. 6 depicts an example printer network 1000. A plurality of printing devices 100*a-c* is connected to a network 400. Each of the printing devices 100*a-c* may have a communication device that communicates with the network 400. In addition, the printing devices 100*a-c* are connected via the network 400 to a centralized database 500.

The centralized database 500 may provide historical power ranges of each of the respective printing devices 100*a-c*. In this way, each printing device may (1) calculate a predetermined power range based on its own historical power range, and thus, its own usage history; and (2) operate based on the calculated predetermined power range. Additionally, or alternatively, each printing device may (1) calculate a predetermined power range based on historical power ranges of at least one other printing device, and thus, the usage history of at least one other printing device; and (2) operate based on the calculated predetermined power range.

In this example, the network 400 also connects a user device 600*a* to the corresponding printing device 100*a*. In this way, the user device 600*a* may receive a status feedback from the printing device 100*a*. In a variation, each of the printing devices 100*a-c* may be connected via network 400 to a corresponding device of a user of the respective printing device. Similarly, each of the printing devices may be connected via the network 400 to a device of a remote party (such as a service engineer) so that a status feedback may be transmitted to the remote party.

As discussed above, the memory 150 of the printing device 100 may store a computer readable storage medium 155 encoded with instructions executable by the processor 120. In the example of FIG. 6, each of the printing devices 100*a-c* stores (in a memory component corresponding to memory 150 and the computer readable medium 155 of device 100) instructions 111*a-c* that are executable by a processor to implement the previously described methods 200 and 290.

The storage medium 155 may be any media that can contain, store or maintain programs and data for use by or in connection with an instruction execution system. In this case, machine-readable media can comprise any one of many physical media such as, for example, electronic, magnetic, optical, electromagnetic, or semiconductor media. More specific examples of suitable machine-readable media include, but are not limited to, a hard drive, a random-access memory (RAM), a read-only memory (ROM), an erasable programmable read-only memory, or a portable disc.

The computer readable storage medium 155 may comprise: instructions to determine the heating power of the heating apparatus, instructions to compare the heating power to a predetermined power range, instructions to determine a status of the temperature sensor when the heating power is outside the predetermined power range, and instructions to trigger a response mode of the printing device based on the determined status of the temperature sensor.

The reference to "printing device" used herein describes a plurality of components of a printer, where the plurality of components may be a subset of components of the overall printer.

In one example, there is provided a printing device comprising a heating apparatus arranged to heat an image substrate; a temperature sensor associated with the image substrate; and a processor communicatively coupled to the heating apparatus; wherein the processor is configured to determine a temperature control of the heating apparatus based on the heating power of the heating apparatus. The processor may determine the temperature control by comparing the heating power of the heating apparatus to a predetermined power range. In one example, the processor may trigger the printing device to take an action based on the determined temperature control.

In the preceding description, for purposes of explanation, numerous specific details of certain examples are set forth. Reference in the specification to "an example" or similar language means that a particular feature, structure, or characteristic described in connection with the example is included in at least that one example, but not necessarily in other examples.

The above examples are to be understood as illustrative. It is to be understood that any feature described in relation to any one example may be used alone, or in combination with other features described, and may also be used in combination with one or more features of any other of the examples, or any combination of any other of the examples. Furthermore, equivalents and modifications not described above may also be employed.

The invention claimed is:

1. A printing device comprising:

a heating apparatus arranged to heat an image substrate;

a temperature sensor that measures a temperature of the image substrate; and a processor communicatively coupled to the heating apparatus;

wherein the processor is configured to:

determine a heating power of the heating apparatus based on the measured temperature of the image substrate;

compare the heating power to a predetermined power range;

determine a status of the temperature sensor when the heating power is outside the predetermined power range; and trigger a response mode of the printing device based on the determined status of the temperature sensor.

2. The printing device of claim 1, wherein the predetermined power range is calculated from at least one of:

a theoretical heat model;

a history of power ranges of the printing device;

a power range of one other printing device;

one or more power ranges of a plurality of other printing devices;

a performance of a printer component of the printing device; and a performance of a printer component of a plurality of printing devices.

3. The printing device of claim 2, wherein the printing device comprises a communication device communicatively coupled to the processor and the communication device is configured to receive the predetermined power range from at least one of:

a database associated with the printing device;

one other printing device;

a database associated with the one other printing device;

a plurality of other printing devices; and a database associated with a plurality of other printing devices.

4. The printing device of claim 1, wherein the processor is configured to determine a trend of behavior of the printing device, based on at least one of:

a history of heating power of the heating apparatus, a history of power ranges of the printing device;

a power range of one other printing device; and one or more power ranges of a plurality of other printing devices.

5. The printing device of claim 1, wherein, in the response mode, the processor is configured to trigger at least one of:

status feedback to a user of the printing device; and status feedback to a remote party associated with the printing device.

6. The printing device of claim 1, wherein the printing device comprises a communication device communicatively coupled to the processor and the communication device is configured to transmit at least one of:

the status feedback to a device associated with a user of the printing device;

the status feedback to a database associated with a remote party associated with the printing device; and the status feedback to a device associated with a remote party associated with the printing device.

7. The printing device of claim 1, wherein the processor is configured to determine the heating power of the heating apparatus and compare the heating power to a predetermined power range when the heating power is within the predetermined power range.

8. A computer-implemented method comprising:

determining, by a processor communicatively coupled to a heating apparatus of a printing device, a heating power of the heating apparatus of the printing device based on a measured temperature of an image substrate heated by the heating apparatus, the measured temperature of the image substrate being measured by a temperature sensor;

comparing, by the processor, the heating power to a predetermined power range; and when the heating power is outside the predetermined power range:

determining, by the processor, a status of the temperature sensor; and triggering, by the processor, a response mode of the printing device based on the determined status of the temperature sensor.

9. The computer-implemented method of claim 8, wherein the predetermined power range is calculated from at least one of:

a theoretical heat model;

a history of power ranges of the printing device;

a power range of one other printing device;

one or more power ranges of a plurality of other printing devices;

a performance of a printer component of the printing device; and a performance of a printer component of a plurality of printing devices.

10. The computer-implemented method of claim 8, comprising receiving the predetermined power range from at least one of:

a database associated with the printing device;

one other printing device;

a database associated with the one other printing device;

a plurality of other printing devices; and a database associated with a plurality of other printing devices.

11. The computer-implemented method of claim 8, comprising, in the response mode, triggering at least one of:

status feedback to a user of the printing device; and status feedback to a remote party associated with the printing device.

12. The computer-implemented method of claim 11, comprising transmitting at least one of:

the status feedback to a device associated with a user of the printing device;

the status feedback to a database associated with a remote party associated with the printing device; and the status feedback to a device associated with a remote party associated with the printing device.

13. The computer-implemented method of claim 8, comprising:

determining, by the processor, a second status of the temperature sensor when the heating power is inside the predetermined power range; and maintaining, by the processor, a current mode of the printing device based on the determined second status of the temperature sensor.

14. The computer-implemented method of claim 8, comprising determining a trend of behavior of the printing device, based on at least one of:

a history of heating power of the heating apparatus;

a history of power ranges of the printing device;

a power range of one other printing device; and one or more power ranges of a plurality of other printing devices.

15. A computer readable storage medium encoded with instructions executable by a processor, the computer readable storage medium comprising:

instructions to determine a heating power of a heating apparatus device based on a measured temperature of an image substrate heated by the heating apparatus, the measured temperature of the image substrate being measured by a temperature sensor;

instructions to compare the heating power to a predetermined power range;

instructions to determine a status of the temperature sensor when the heating power is outside the predetermined power range; and instructions to trigger a response mode of a printing device based on the determined status of the temperature sensor.

* * * * *